US007196569B1

(12) United States Patent
DiTommaso

(10) Patent No.: US 7,196,569 B1
(45) Date of Patent: Mar. 27, 2007

(54) FEEDBACK COMPENSATION FOR LOGARITHMIC AMPLIFIERS

(75) Inventor: Vincenzo DiTommaso, Beaverton, OR (US)

(73) Assignee: Analog Devices, Inc., Norwood, MA (US)

( * ) Notice: Subject to any disclaimer, the term of this patent is extended or adjusted under 35 U.S.C. 154(b) by 84 days.

(21) Appl. No.: 11/058,085

(22) Filed: Feb. 14, 2005

(51) Int. Cl.
*G06G 7/24* (2006.01)

(52) U.S. Cl. ..... 327/350; 327/351

(58) Field of Classification Search ..... 327/350–353
See application file for complete search history.

(56) References Cited

U.S. PATENT DOCUMENTS 3,736,515 A * 5/1973 Kadron et al. ..... 327/334
4,565,935 A * 1/1986 Rolfe ..... 327/350
4,990,803 A 2/1991 Gilbert ..... 327/351
5,298,811 A 3/1994 Gilbert ..... 327/351
5,345,185 A * 9/1994 Gilbert ..... 327/350
5,451,895 A * 9/1995 Lim ..... 327/351
5,489,868 A 2/1996 Gilbert ..... 327/351
5,572,166 A * 11/1996 Gilbert ..... 330/254
5,754,013 A * 5/1998 Praiswater ..... 315/307
5,805,011 A * 9/1998 Comino ..... 327/563
5,877,645 A * 3/1999 Comino et al. ..... 327/350
6,144,244 A * 11/2000 Gilbert ..... 327/350
6,311,049 B1 * 10/2001 Yoshizawa ..... 455/250.1

OTHER PUBLICATIONS

Gilbert, Barrie, Analog Devices, Inc.; *Monolithic Logarithmic Amplifiers,* Aug. 1994, pp. 1-122.
Gilbert, Barrie, *Translinear Circuits: An Historical Overview,* Analog Integrated Circuits and Signal Processing, 1996, pp. 95-118.
Analog Devices, Inc., *DC-Coupled Demodulating 120 MHz Logarithmic Amplifier* (*AD640*) (Rev. C), 1999, pp. 1-16.

* cited by examiner

*Primary Examiner*—Kenneth B. Wells
(74) *Attorney, Agent, or Firm*—Marger, Johnson & McCollom, PC

(57) ABSTRACT

A logarithmic amplifier is compensated by a feedback loop. The feedback loop may control a series of detector cells in response to an output from one or more of the detector cells. The feedback loop may be used to provide frequency compensation to the log amp by adjusting the bias currents to the detector cells. One detector cell may be arranged to generate a limiting signal while another detector cell is arranged to generate a zero signal. By arranging the feedback loop to adjust the bias cell so as to maintain the difference between the limit signal and the zero signal at a constant value, the output swing of the detector cells is held constant, thereby stabilizing the slope of the log amp.

25 Claims, 6 Drawing Sheets

FEEDBACK COMPENSATION FOR LOGARITHMIC AMPLIFIERS

BACKGROUND

A logarithmic amplifier ("log amp") generates an output signal $V_{OUT}$ that is related to its input signal $V_{IN}$ by the following transfer function:

$$V_{OUT}=V_Y \log(V_{IN}/V_Z) \quad \text{Eq. 1}$$

where $V_Y$ is the slope and $V_Z$ is the intercept as shown in idealized form in FIG. 1. Progressive compression type log amps achieve the logarithmic transfer function through the combined effect of multiple gain stages and detector cells that approximate a logarithmic law.

FIG. 2 illustrates a prior art progressive compression log amp. The log amp of FIG. 2 includes a series of cascaded gain stages 10, each of which has a relatively low linear gain up to some critical level. Above the critical level, the gain of each stage is limited to a lower level—in some cases to zero. Thus, they are also referred to as amplifier/limiter stages. A series of detector cells 12 are connected to corresponding gain stages. The outputs of the detector cells are added together to generate the log output signal. In this example, the detector cell outputs are current mode signals, so they can be added together through a simple summing connection at node N1.

FIG. 3 illustrates a prior art detector cell based on three transistors arranged as a rectifying transconductance (gm) cell. The emitter areas of the transistors are ratioed; that is, transistors Q1 and Q3 have a unit emitter area of "e", while transistor Q2 has an emitter area of D times e. The input signal is applied across the bases of Q1 and Q3 as a differential voltage $V_{IN}$. The base of Q2 is held at the midpoint of the input signal by the divider formed by input resistors $R_B$.

The bias current $I_T$ (also referred to as a quiescent or tail current) through transistors Q1–Q3 is generated by a bias transistor QA. The level of bias current $I_T$ is determined by the voltage applied to the base of QA. An operational amplifier (op amp) 14 maintains the base of QA at the voltage $V_{REF}$ which is typically generated by a precision voltage reference. The same reference voltage is also applied to the bases of additional bias transistors QB, QC, etc., which provide the same bias current to the other detector cells.

The collector currents of Q1 and Q3 are summed together to form one detector output current $I_P$, while the collector current of Q2 provides another output current $I_N$. Either or both of the output currents may be used to generate the final logarithmic output. If $I_P$ is used as the sole output signal, the current $I_N$ may be diverted to a positive power supply $V_P$, and the output current $I_P$ has the form shown in FIG. 4. $I_0$ is the output current when the input signal is zero, that is, $V_{IN}=0$. $I_L$ is the limit of the signal available from the detector cell when the input signal is large. Thus the maximum current swing M available at the detector output is $M=I_L-I_0$ and is related to the bias current $I_T$ and the emitter area ratio D.

FIG. 5 illustrates the detector cell output current $I_P$ in logarithmic form for several detector cells in a progressive compression log amp in which each detector cell is implemented using the $I_P$ output from the circuit of FIG. 3. The curves are shown as a function of the log input signal LOG INPUT on a logarithmic scale. The left-most curve in FIG. 5 is for the first detector cell, the next curve is for the second detector cell, etc. Each curve is offset relative to the others because the input $V_{IN}$ to any specific detector cell is shifted relative to the main LOG INPUT signal depending on its location along the cascade of gain stages. Thus, each curve is offset from its adjacent curve by an amount that is related to the gain A of each gain stage 10. Assuming each detector cell is fabricated using identical components on an integrated circuit, $I_L$, $I_0$, and M will be essentially identical for each detector cell.

FIG. 6 illustrates the final output signal obtained by summing together the output currents $I_P$ from all of the detector cells. The final output signal approximates the ideal log function shown in FIG. 1. Since each of the individual curves shown in FIG. 5 has the same maximum output swing M, the slope of the final output signal is strongly dependent on the value of M which determines the height of each of the piecewise linear approximation sections in the final output function.

Referring back to FIG. 3, if the other output current $I_N$ is used to generate the final logarithmic output, $I_P$ may be diverted to the power supply, and the $I_N$ output has an inverted shape as shown in FIG. 7. In this case, summing together the $I_N$ outputs from all of the detector cells produces a final log output signal having a negative slope as shown in FIG. 8. Note that in either case, the relative vertical position of the individual curves in FIGS. 5 and 7 generally does not affect the log slope. That is, a DC offset may be added to the curves in FIGS. 5 and 7 to shift them up or down without affecting the maximum output swing M that determines the slope of the final logarithmic output.

DETAILED DESCRIPTION

Figure 9:
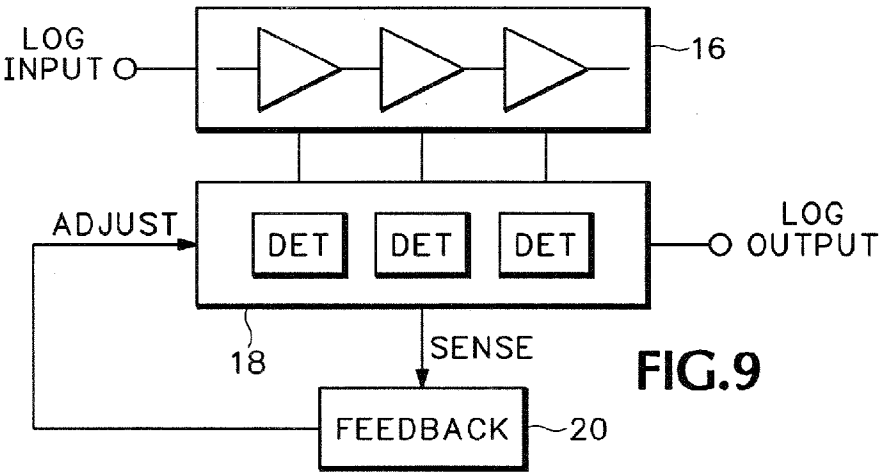
FIG. 9 illustrates an embodiment of a log amp according to the inventive principles of this patent disclosure.

FIG. 9 illustrates an embodiment of a log amp having a feedback loop according to the inventive principles of this patent disclosure. The embodiment of FIG. 9 includes a series of cascaded gain stages 16 and a series of detector cells 18 in which each detector cell is connected to a corresponding gain stage. The outputs of the detector cells are added together to generate the log output signal. A feedback circuit 20 controls the operation of the detector cells in response to an output from one or more detector cells.

The feedback loop in the embodiment of FIG. 9 enables the implementation of features such as slope compensation. For example, as discussed above, the output slope of a log amp may depend on the maximum signal swing M of the detector cells 18. The value of M, however, may be affected by factors such as the frequency of the input signal, process variations, temperature, power supply, etc. If the value of M, that is $I_L-I_0$, is held constant, the slope of the log amp may be stabilized. The feedback loop in the embodiment of FIG. 9 may allow the operation of the detector cells to be adjusted so as to maintain M at a constant value.

Figure 1:
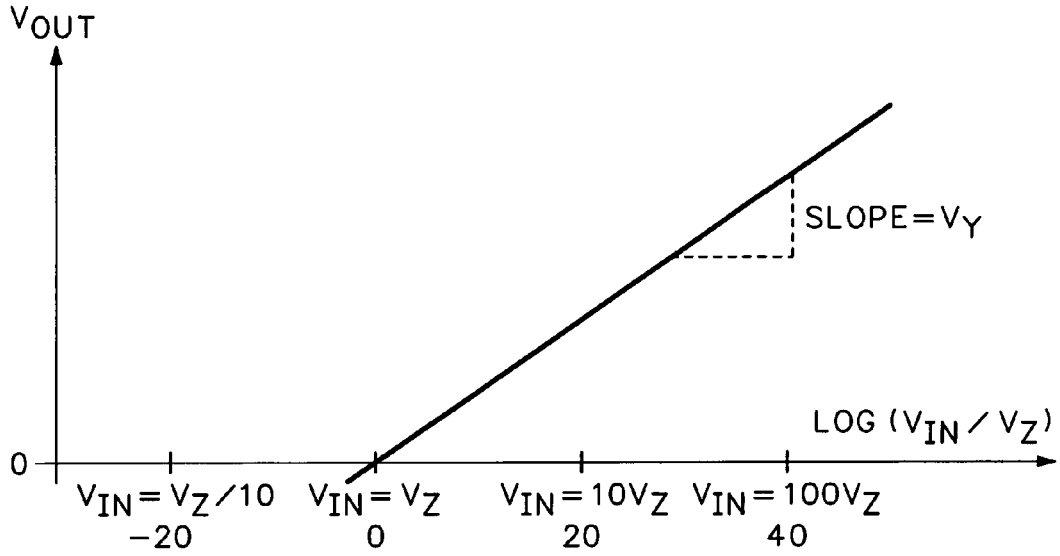
FIG.1 (PRIOR ART)
FIG. 1 illustrates an idealized log amp function.
Figure 2:
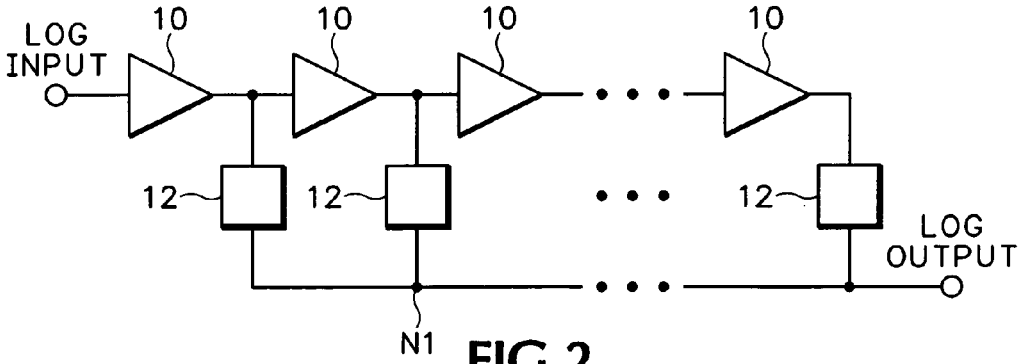
FIG.2 (PRIOR ART)
FIG. 2 illustrates a prior art progressive compression log amp.
Figure 3:
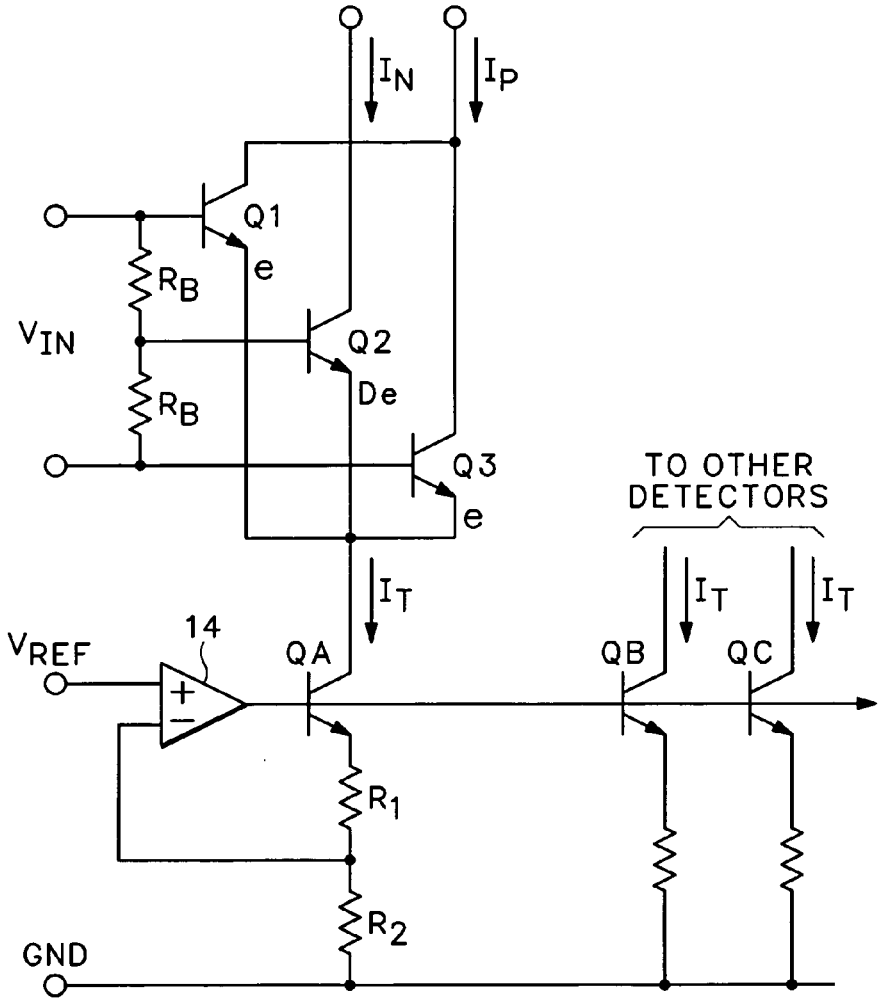
FIG.3 (PRIOR ART)
FIG. 3 illustrates a prior art detector cell for a progressive compression log amp.
Figure 4:
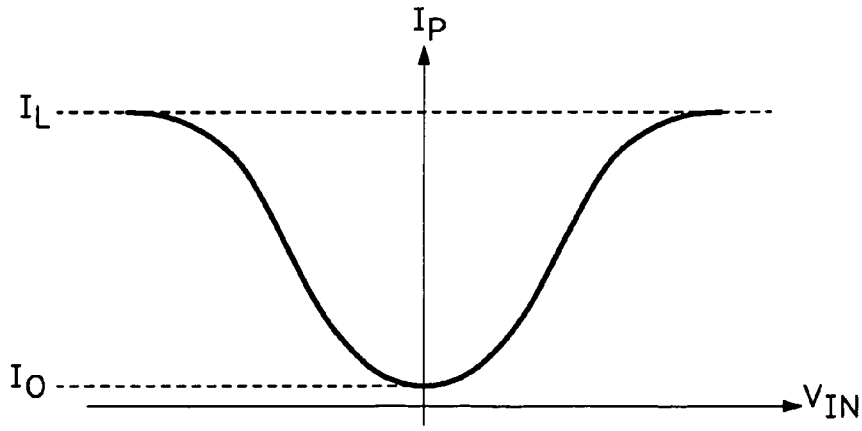
FIG. 4 illustrates the form of one output of the detector cell of FIG. 3.
Figure 5:
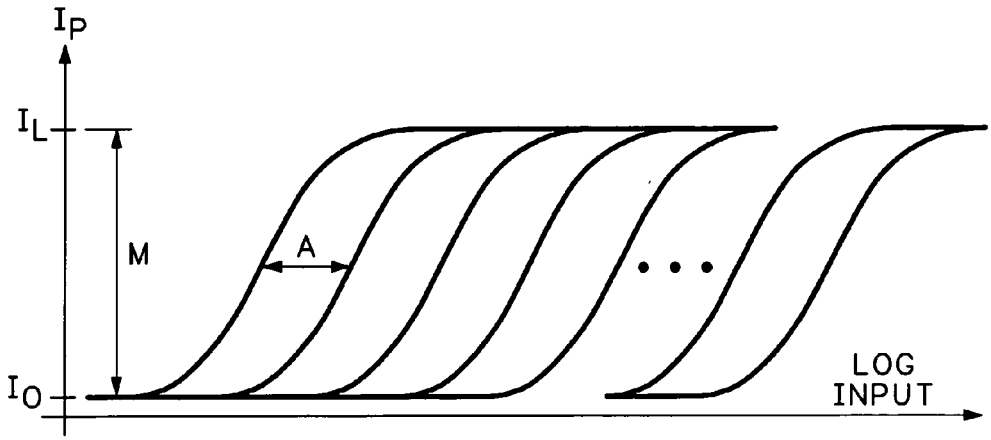
FIG. 5 illustrates the logarithmic form of the outputs form of several detector cells in a prior art progressive compression log amp.
Figure 6:
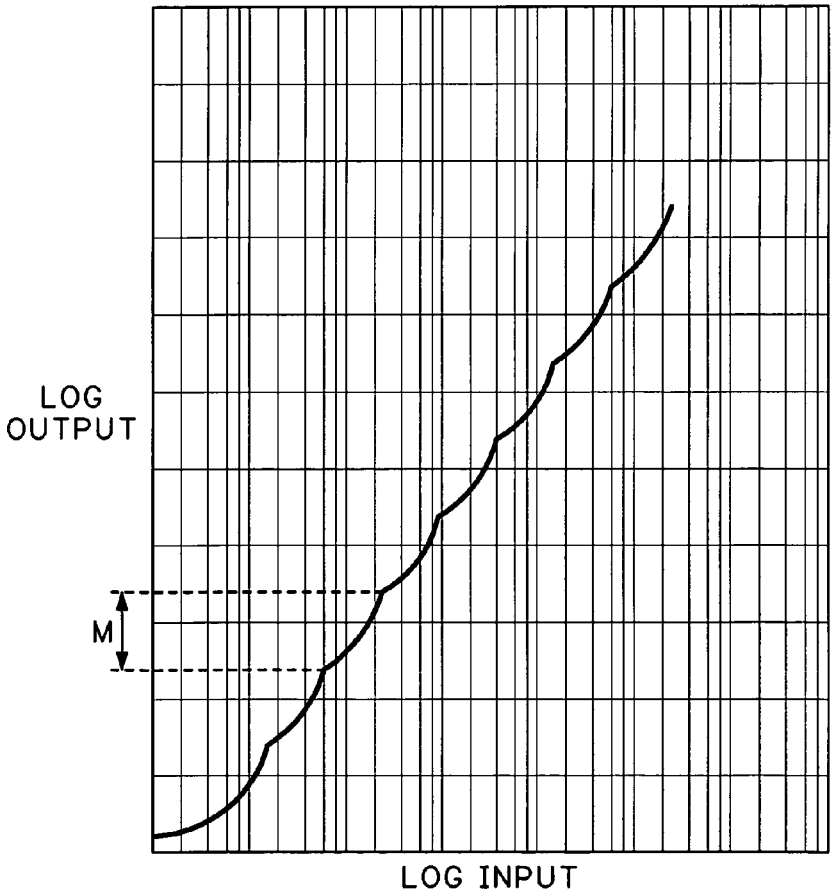
FIG. 6 illustrates the final output function obtained by summing together the outputs from several of the prior art detector cells of FIG. 3.
Figure 7:
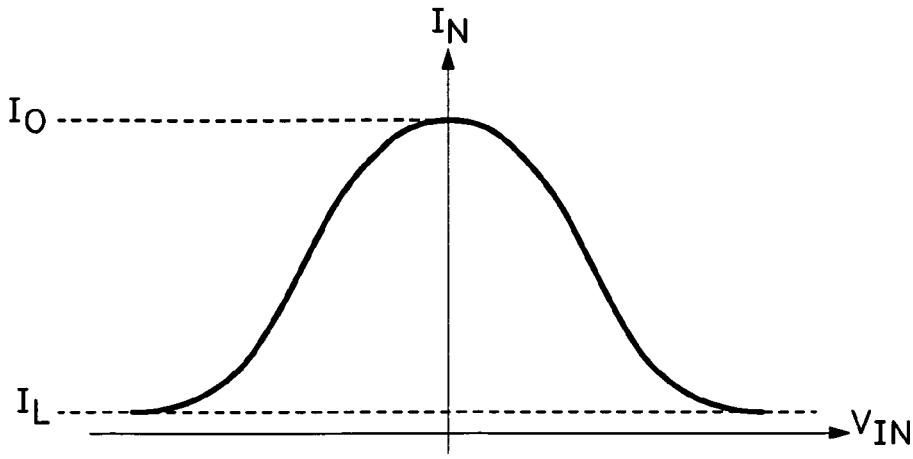
FIG. 7 illustrates the form of another output of the detector cell of FIG. 3.
Figure 8:
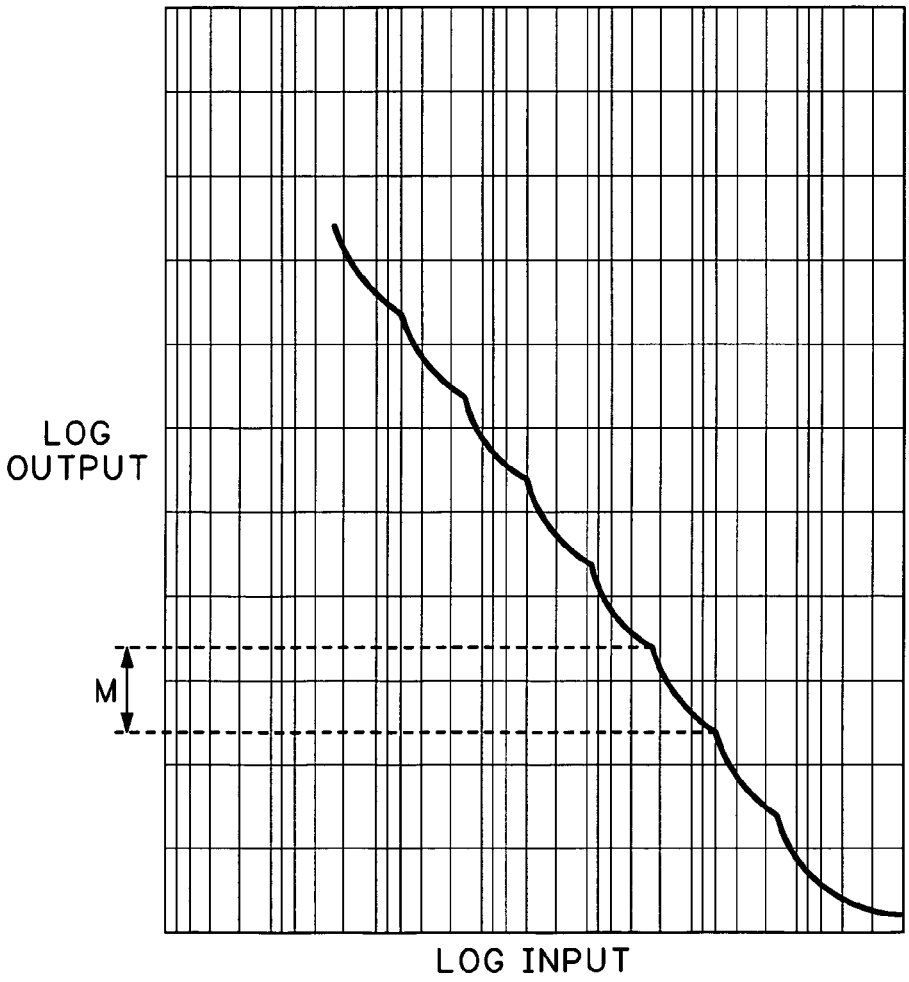
FIG. 8 illustrates the final output function obtained by summing together the other outputs from several of the prior art detector cells of FIG. 3.
Figure 10:
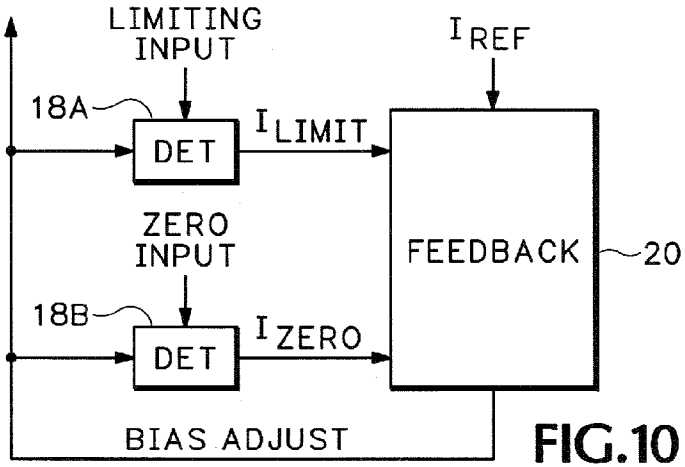
FIG. 10 illustrates an embodiment of a system for adjusting the bias of detector cells according to the inventive principles of this patent disclosure.

FIG. 10 illustrates an embodiment of a closed loop system that may be used to provide slope compensation to a log amp by adjusting the bias of detector cells according to the inventive principles of this patent disclosure. In the embodiment of FIG. 10, the series of detector cells includes a dedicated detector cell 18A that is arranged so that it essentially always operates in a limiting mode. That is, its output current $I_{LIMIT}$ is $I_L$. Another detector cell 18B is arranged so that it always outputs $I_0$. The feedback circuit 20 generates a signal BIAS ADJUST that servos the detector cells so as to maintain the difference between $I_{LIMIT}$ and $I_{ZERO}$ at a constant value determined by a reference signal $I_{REF}$. That is, $I_{LIMIT}-I_{ZERO}=I_{REF}$. Thus, by maintaining M at a constant value, the slope of the accompanying log amp may be stabilized if all of the detector cells are fabricated with matching components.

The reference signal $I_{REF}$ may be generated internally, as for example, by using an on-chip bandgap reference cell to generate a reference voltage that may be converted to a current signal. Alternatively, the reference signal may be applied from an external source to provide the user with a convenient way to adjust the slope of the log amp, or to provide the ability to compensate for other aspects of the operation of the log amp. For example, an on-chip bandgap cell may not be perfectly temperature stable, or it may be noisy enough to cause objectionable noise in the log amp output. By providing the ability to utilize an external reference signal, the user may achieve higher levels of accuracy in the slope and compensation depending on the type of external reference applied to the chip. This may also eliminate the need for an on-chip reference cell, which in turn, may result in lower power consumption, less die area (i.e., less expensive device), lower noise output, and/or more flexibility to the end user. Another advantage is that the slope may easily be adjusted either upward or downward. This is in contrast to conventional arrangements in which the slope could only be adjusted downward by putting a resistive divider in the setpoint interface.

Figure 11:
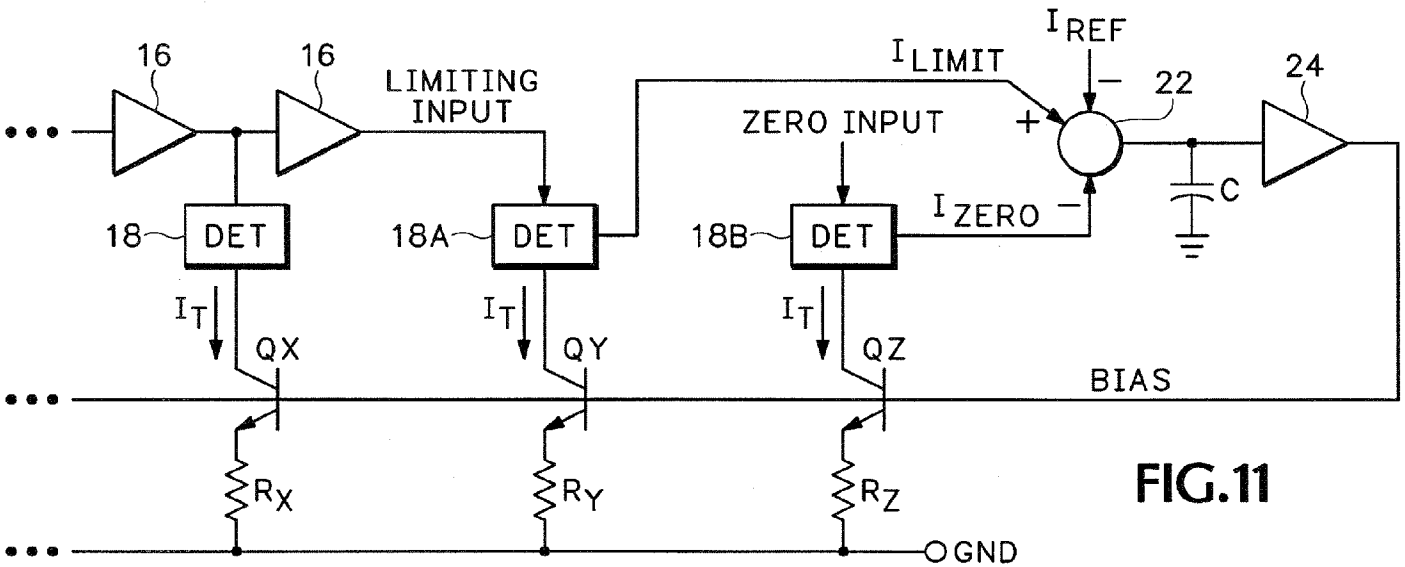
FIG. 11 illustrates another embodiment of a log amp according to the inventive principles of this patent disclosure.

FIG. 11 illustrates another embodiment showing some possible implementation details of a log amp according to the inventive principles of this patent disclosure. In the embodiment of FIG. 11, the limiting detector cell 18A implemented by placing it at the end of the cascade of gain stages 16 and setting the gain so that even just noise forces its output to limit. The zero detector cell 18B is implemented by, for example, shorting its inputs together. The signals $I_{LIMIT}$, $I_{ZERO}$, and $I_{REF}$ are summed by a summing circuit 22. A capacitor C and buffer amplifier 24 integrate the output from the summing circuit to generate a bias signal BIAS which drives the bases of bias transistors QX, QY, QZ, etc., which in turn provide the bias currents $I_T$ to the detector cells.

Figure 12:
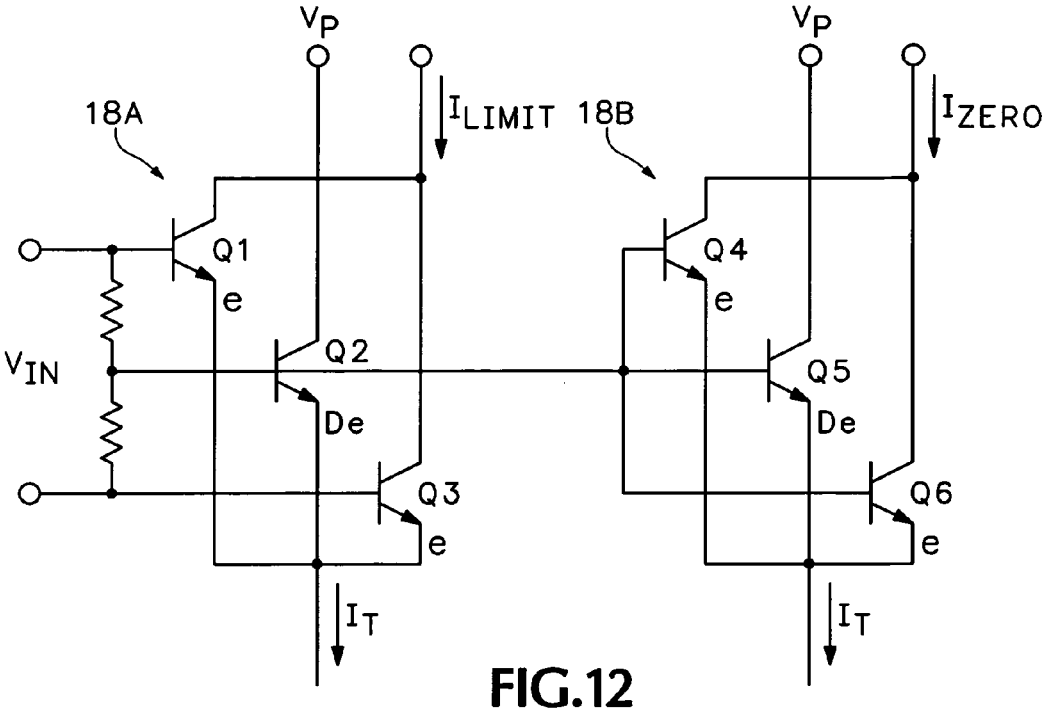
FIG. 12 illustrates an embodiment of limiting and zero detector cells according to the inventive principles of this patent disclosure.

FIG. 12 illustrates an alternative embodiment of limiting and zero detector cells according to the inventive principles of this patent disclosure. The embodiment of FIG. 12 includes a detector cell 18A that is forced into limiting operation by the output of a gain stage 16 that is arranged to always operate in limiting mode. Another detector cell 18B is forced to generate a zero signal $I_{ZERO}$ by tying its input terminals together. As an added feature, however, the inputs of the zero detector cell are also connected to the midpoint of the input to the limiting detector cell 18A. This imparts a ripple component to the $I_{ZERO}$ signal that may compensate for similar ripple components in output signals from the limiting detector cell ($I_{LIMIT}$) and other detector cells.

Figure 13:
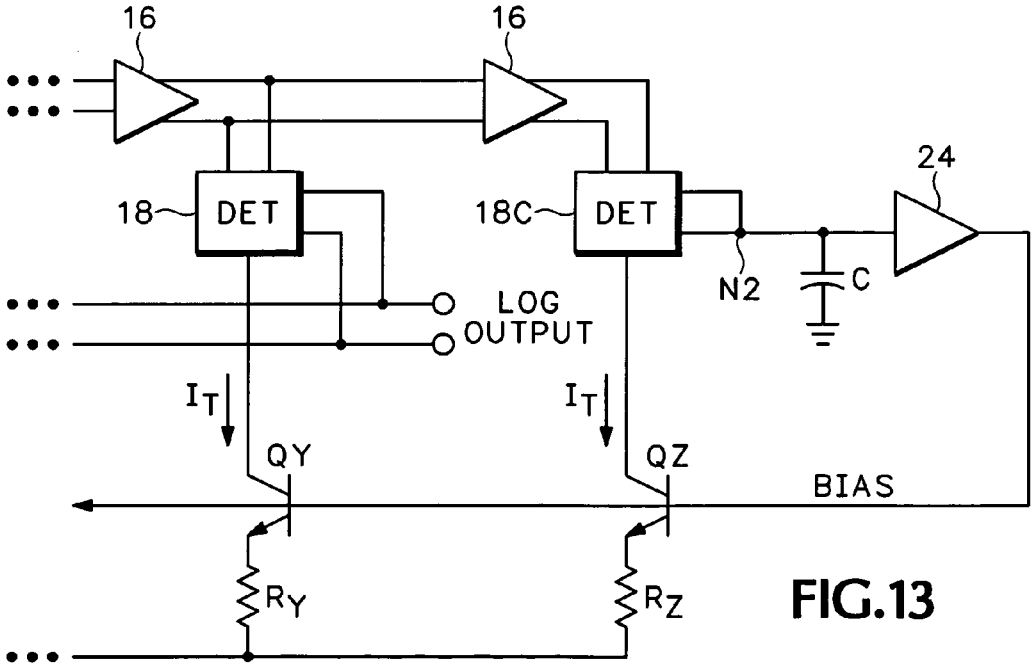
FIG. 13 illustrates another embodiment of a log amp according to the inventive principles of this patent disclosure.

FIG. 13 illustrates another embodiment of a log amp having feedback control of detector cells according to the inventive principles of this patent disclosure. The embodiment of FIG. 13 is shown as a fully differential system. Instead of having separate limiting and zero detector cells, however, a single detector cell 18C having a differential output is utilized. This maybe implemented, for example, by using both the $I_P$ and $I_N$ outputs of a transconductance detector cell. The differential outputs are summed at a summing node N2 and then integrated by capacitor C and buffer 24 to generate a bias feedback signal that maintains the difference between the $I_P$ and $I_N$ outputs at a constant value.

This patent disclosure encompasses numerous inventions relating to compensation of log amps. These inventive principles have independent utility and are independently patentable. In some cases, additional benefits are realized when some of the principles are utilized in various combinations with one another, thus giving rise to yet more patentable inventions. These principles can be realized in countless different embodiments. Although some specific details are shown for purposes of illustrating the preferred embodiments, other effective arrangements can be devised in accordance with the inventive principles of this patent disclosure. For example, some transistors have been illustrated as bipolar junction transistors (BJTs), but CMOS and other types of devices may be used as well. Likewise, some signals and mathematical values have been illustrated as voltages or currents, but the inventive principles of this patent disclosure are not limited to these particular signal modes. As a further example, some detector cells have been illustrated as three-transistor transconductance cells, but other type of detector cells may be utilized.

The inventive principles disclosed above are not limited to frequency compensation of detector cells. For example, a feedback loop according to the inventive principles of this patent disclosure may be arranged to compensate any part of the log amp for variations in any aspect of operation or construction such as temperature, process variations, temperature, power supply variations, etc. Thus, in the embodiment of FIG. 9, the SENSE input to, and ADJUST output from, the feedback network may be taken from or applied to parts of the log amp other than just the detector cells 18.

Since the embodiments described above can be modified in arrangement and detail without departing from the inventive concepts, such changes and modifications are considered to fall within the scope of the following claims.

The invention claimed is:

1. A logarithmic amplifier comprising:

a series of gain stages;

a series of detector cells coupled to respective gain stages; and a feedback loop arranged to compensate the logarithmic amplifier by controlling the detector cells in response to an output from one or more of the detector cells.

2. The amplifier of claim 1 where the series of detector cells comprises:

a detector cell to generate a limit output; and a detector cell to generate a zero output.

3. The amplifier of claim 2 where the feedback loop comprises a feedback circuit to control the detector cells to maintain the difference between the limit output and the zero output at a fixed value.

4. The amplifier of claim 3 where the feedback loop is arranged to control the detector cells by adjusting bias currents to the detector cells.

5. The amplifier of claim 1 where the series of detector cells comprises a detector cell having a differential output.

6. The amplifier of claim 5 where the feedback loop comprises a summing node coupled to the differential output of the detector cell.

7. The amplifier of claim 6 where the feedback loop further comprises an integrator coupled to the summing node and arranged to control the detector cells by adjusting bias currents to the detector cells.

8. The amplifier of claim 1 where the feedback loop is to compensate for variations of an aspect selected from the group consisting of: frequency, process, temperature, and power supply.

9. The amplifier of claim 1 where the feedback loop is to compensate the amplifier in response to an external reference signal.

10. The amplifier of claim 1 where the feedback loop is arranged to compensate the slope of the logarithmic amplifier.

11. The amplifier of claim 1 where the detector cells are substantially identical.

12. The amplifier of claim 9 where the feedback loop is arranged to adjust the slope of the amplifier in response to the external reference signal.

13. The amplifier of claim 12 where the slope may be adjusted upward or downward in response to the external reference signal.

14. A method comprising:

operating a logarithmic amplifier by driving a series of detector cells with a series of gain stages; and compensating the logarithmic amplifier with feedback by adjusting the series of detector cells in response to an output from one of the detector cells.

15. The method of claim 14 further comprising:

operating one of the series of detector cells at a limiting output; and operating another one of the series of detector cells at a zero output.

16. The method of claim 15 further comprising maintaining the difference between the limiting output and the zero output at a fixed value.

17. The method of claim 16 where adjusting the series of detector cells comprises adjusting bias currents to the detector cells.

18. The method of claim 14 further comprising operating one of the series of detector cells with differential outputs.

19. The method of claim 18 further comprising summing the differential outputs.

20. The method of claim 19 further comprising adjusting bias currents to the detector cells in response to the differential outputs.

21. The method of claim 14 where compensating the logarithmic amplifier with feedback comprises compensating for variations of an aspect selected from the group consisting of: frequency, process, temperature, and power supply.

22. A logarithmic amplifier comprising:

means for generating a series of amplified signals;

means for detecting the series of amplified signals; and means for compensating the logarithmic amplifier, including means for controlling the means for detecting responsive to an output from the means for detecting.

23. The amplifier of claim 22 where the means for detecting comprises:

means for generating a limit signal; and means for generating a zero signal.

24. The amplifier of claim 23 where the means for controlling comprises means for maintaining the difference between the limit output and the zero output at a fixed value.

25. The amplifier of claim 24 where the means for controlling further comprises means for biasing the means for detecting.

* * * * *